US005359794A

United States Patent [19]

Wood

[11] Patent Number: 5,359,794

[45] Date of Patent: Nov. 1, 1994

[54] PICTURE FRAME AND SHEET BLANK THEREFOR

[75] Inventor: Harold W. Wood, Portland, Oreg.

[73] Assignee: Tickers, Inc., Portland, Oreg.

[21] Appl. No.: 9,328

[22] Filed: Jan. 26, 1993

[51] Int. Cl.[5] ..... A47G 1/06

[52] U.S. Cl. ..... 40/155; 40/154

[58] Field of Search ..... 40/152, 152.1, 155, 40/159, 539, 537, 594, 154

[56] References Cited

U.S. PATENT DOCUMENTS

| | | | |
|---|---|---|---|
| 1,450,190 | 4/1923 | Sonn . | |
| 1,513,050 | 10/1924 | Kristofek . | |
| 2,203,737 | 6/1940 | Moore . | |
| 2,352,436 | 6/1944 | Horr . | |
| 2,512,957 | 9/1950 | McCargo . | |
| 2,660,825 | 12/1953 | Howard | 40/155 |
| 2,950,556 | 8/1960 | Larios . | |
| 3,214,855 | 11/1965 | Winkler . | |
| 3,286,387 | 11/1966 | Poertner . | |
| 3,587,187 | 6/1971 | Sibley | 40/537 X |
| 3,757,445 | 9/1973 | Stilwell . | |
| 4,738,041 | 4/1988 | Drueck, Jr. | 40/152.1 |
| 4,870,766 | 10/1989 | Topping . | |

FOREIGN PATENT DOCUMENTS

| | | | |
|---|---|---|---|
| 164915 | 9/1955 | Australia . | |
| 909096 | 9/1944 | France | 40/155 |
| 2104378 | 3/1983 | United Kingdom | 40/155 |
| 2220854 | 1/1990 | United Kingdom | 40/152 |

*Primary Examiner*—Brian K. Green

[57] ABSTRACT

A picture frame is formed from a blank of flexible sheet material, such as paper, which is scored and shaped, to provide, when folded, a central rectilinear base section bounded by straight lines, and peripheral frame sections which are joined to each side of the base section and are folded inwardly and overlap the base section. The frame sections extend from the outer margin of the base section outwardly away from the base section and then inwardly toward the base section. Extension flaps provided at each corner fold downward under pressure of the overlapping frame sections to provide visual closure of the corners. Raised adhesive strips secure the peripheral frame sections to the base section. A photo-receiving slot cut through the base section permits exchanging photographs without requiring any disassembly of the picture frame.

12 Claims, 3 Drawing Sheets

PICTURE FRAME AND SHEET BLANK THEREFOR

BACKGROUND OF THE INVENTION

This invention relates to picture frames, and more particularly to a picture frame made from a sheet blank of novel configuration.

Paper and other flexible sheet materials have been employed heretofore in the form of shaped blanks which are cut and/or scored along lines predetermined, when folded, to produce a picture frame of desired configuration. Representative of such picture frames are those disclosed in U.S. Pat. Nos. 1,450,190; 1,513,050; 2,203,737; 2,352,436; 2,512,957; 2,950,556; 3,214,855; 3,286,387; 3,757,445; 4,870,766 and Australian Patent 164,915.

A primary problem characterizing the picture frames disclosed in the above patents is the difficulty of closing the corners of the folded frame. The existing frames either ignore unsightly gaping corners or achieve closure by an interlocking corner assembly. The use of interlocking means to close the corners requires a high level of dexterity and all such designs produce a frame where the peripheral edges project at a 90 degree angle to the base.

SUMMARY OF THE INVENTION

The picture frame of this invention is formed from a blank of flexible sheet material configured to provide straight peripheral frame sections which are closed at the corners and may project at less than a 90 degree angle from the base to produce an attractive beveled border. Visual closure of the corners is accomplished automatically when the extension flap members provided on the inner and middle segments of the first assembled pair of opposed peripheral side sections are overlapped by the second assembled pair of opposed peripheral frame side sections.

The principle objective of this invention is to provide a picture frame of sheet-like construction which overcomes the aforementioned primary problem of prior sheet blank picture frames.

Another objective of this invention is the provision of a picture frame of sheet blank construction in which a picture of choice can be inserted, aligned, and secured before and/or after frame assembly, and changed thereafter as desired.

The foregoing and other objects and advantages of this invention will appear from the following detailed description, taken in connection with the accompanying drawings of preferred embodiment.

DESCRIPTION OF THE PREFERRED EMBODIMENTS

Figure 1:
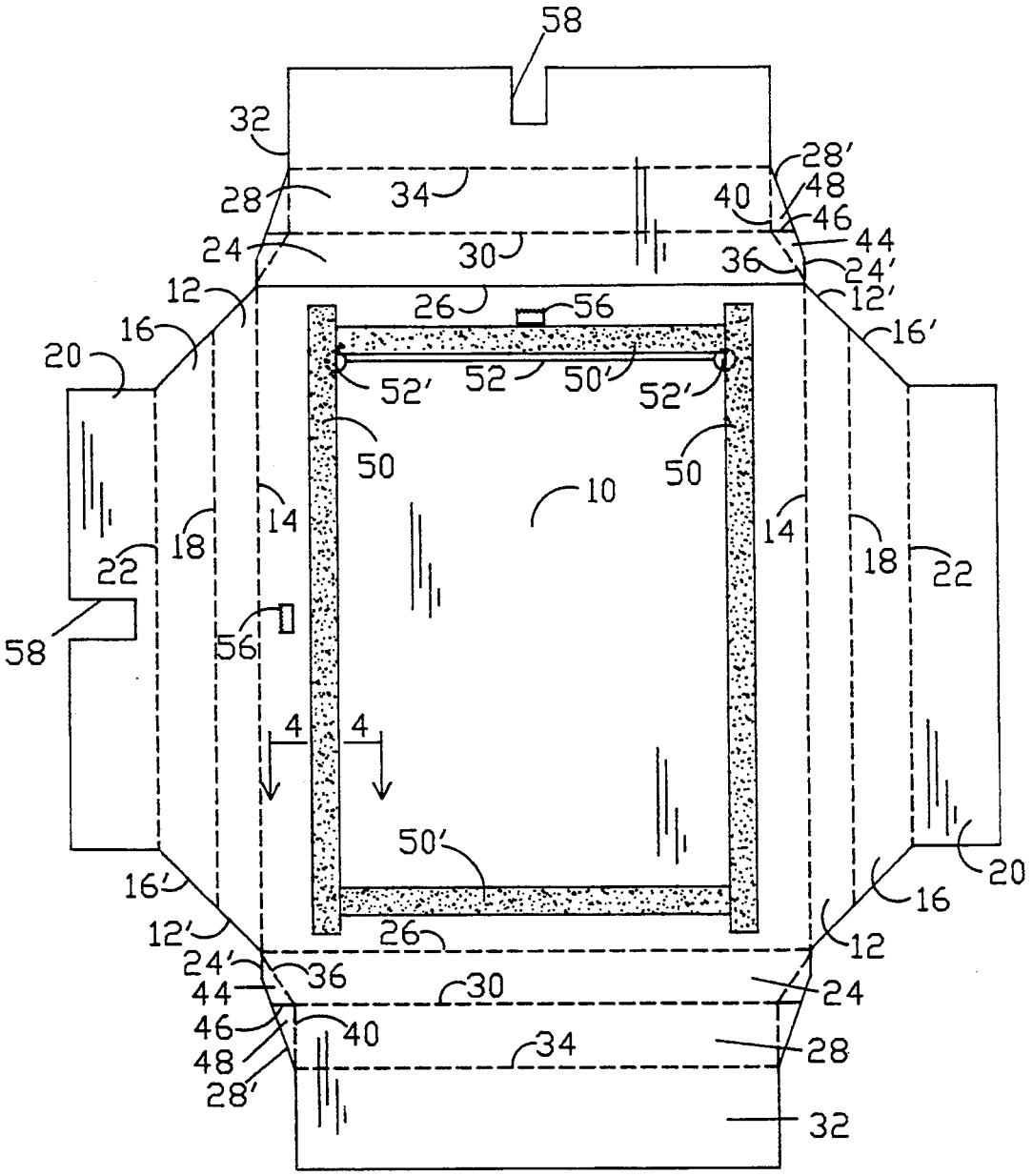
FIG. 1 is a plan view of a sheet blank configured to provide a picture frame embodying the features of this invention.

Referring to the drawings, FIGS. 1–4 illustrate one embodiment of a picture frame formed from a cut-out blank of flexible sheet material, such as paper, paperboard, plastic, and others. The sheet is configured with creased or scored fold lines arranged to provide projecting peripheral side sections which, when folded and secured, form an attractive and functional three-dimensional picture frame for displaying pictures. FIG. 1 shows the picture frame blank configured in accordance with this invention. The blank in this embodiment is configured to form a rectangular frame for displaying a picture. The blank comprises a central, rectilinear base section 10, rectangular in overall shape, and four projecting side members extending outwardly from its four borders as shown.

Figure 2:
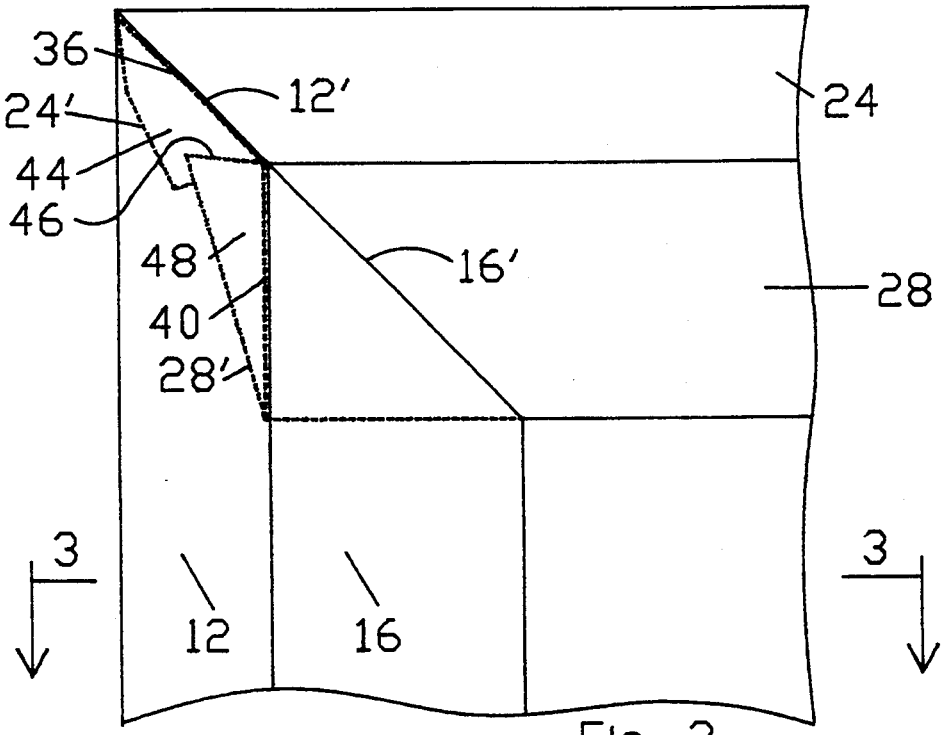
FIG. 2 is a fragmentary plan view, on an enlarged scale, showing one corner of the sheet blank of FIG. 1 folded to produce a finished picture frame, parts normally hidden being shown in broken lines.
Figure 3:
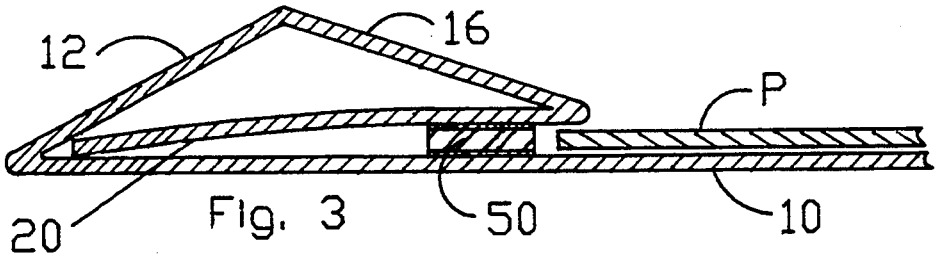
FIG. 3 is a fragmentary sectional view taken on the line 3—3 in FIG. 2.

The projecting side members are defined by angular cuts in the blank, and are each divided into segments by creased or scored fold lines arranged to permit the desired folding of individual peripheral side sections onto the base section 10 to provide a picture-encircling, three-dimensional framing thereof, as understood by viewing FIGS. 2 and 3. With reference to the flexible sheet blank of FIG. 1, and first with particular reference to the side members, a first opposed pair of peripheral side sections associated with the corresponding border of the base section 10, are formed of inner segments 12, defined by angularly cut ends 12' provided in the blank of material, and are connected to and differentiated from the base section by crease or scored fold lines 14. Intermediate, or in this embodiment, middle segments 16 of the first opposed pair of peripheral side sections are defined by angular cut ends 16' in the blank and extend outwardly from the inner segments 12 at scored fold lines 18. Outer segments 20 extend outwardly from middle segments 16 at scored fold lines 22.

A second opposed pair of peripheral side sections comprise inner segments 24 extending outwardly from the base section 10 at connecting scored fold lines 26 and include projecting extension flap members 44 defined by scored fold lines 36. Middle segments 28 of each of the second opposed pair of peripheral side sections extend outwardly from the inner segments 24 at scored fold lines 30 and include projecting extension flap members 48 defined by scored fold lines 40. Outer segments 32 extend outwardly from middle segments 28 at the scored fold lines 34. Extension flap members 44 are defined by the angularly cut ends 24' of inner segments 24 and extend from inner segments 24 at scored fold lines 36. Extension flap members 48 are defined by the angularly cut ends 28' of middle segments 28 and extend from middle segments 28 at scored fold lines 40. The extension flap members 44, 48 are separated from each other by cut lines 46 which form an extension of scored fold lines 30.

As illustrated in FIG. 1, the preferred embodiment of the picture frame of this invention mounts raised adhesive strips 50, 50', and preferably also includes a picture-installing slot 52 and serrated hanging slots 56. The raised adhesive strips 50, 50' are positioned on the base section 10 to form an enclosed picturegraph-receiving and confining channel that enables a picture of choice to be inserted, automatically aligned, and retained in place either before or after the frame has been assembled. The raised adhesive strips 50, 50' also secure the outer side segments 20 and 32 to the base section 10 overlying the border of the picture as seen in FIG. 3.

Figure 4:
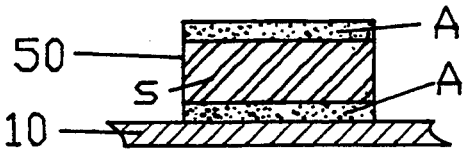
FIG. 4 is a fragmentary sectional view on an enlarged scale, showing a cross section of the raised adhesive strip taken along the line 4—4 in FIG. 1.

A raised adhesive strip composite is illustrated in FIG. 4 showing an adhesive A applied to both sides of a spacer S. The adhesive is preferably of the pressure sensitive type. The spacer can be made from various materials such as fibre board, plastic, paper, wood, foam and the like, the composite preferably demensioned to be greater in thickness than the thickness of the picture to be displayed, in order to maintain free movement of the picture within the channel after the frame has been assembled.

Figure 5:
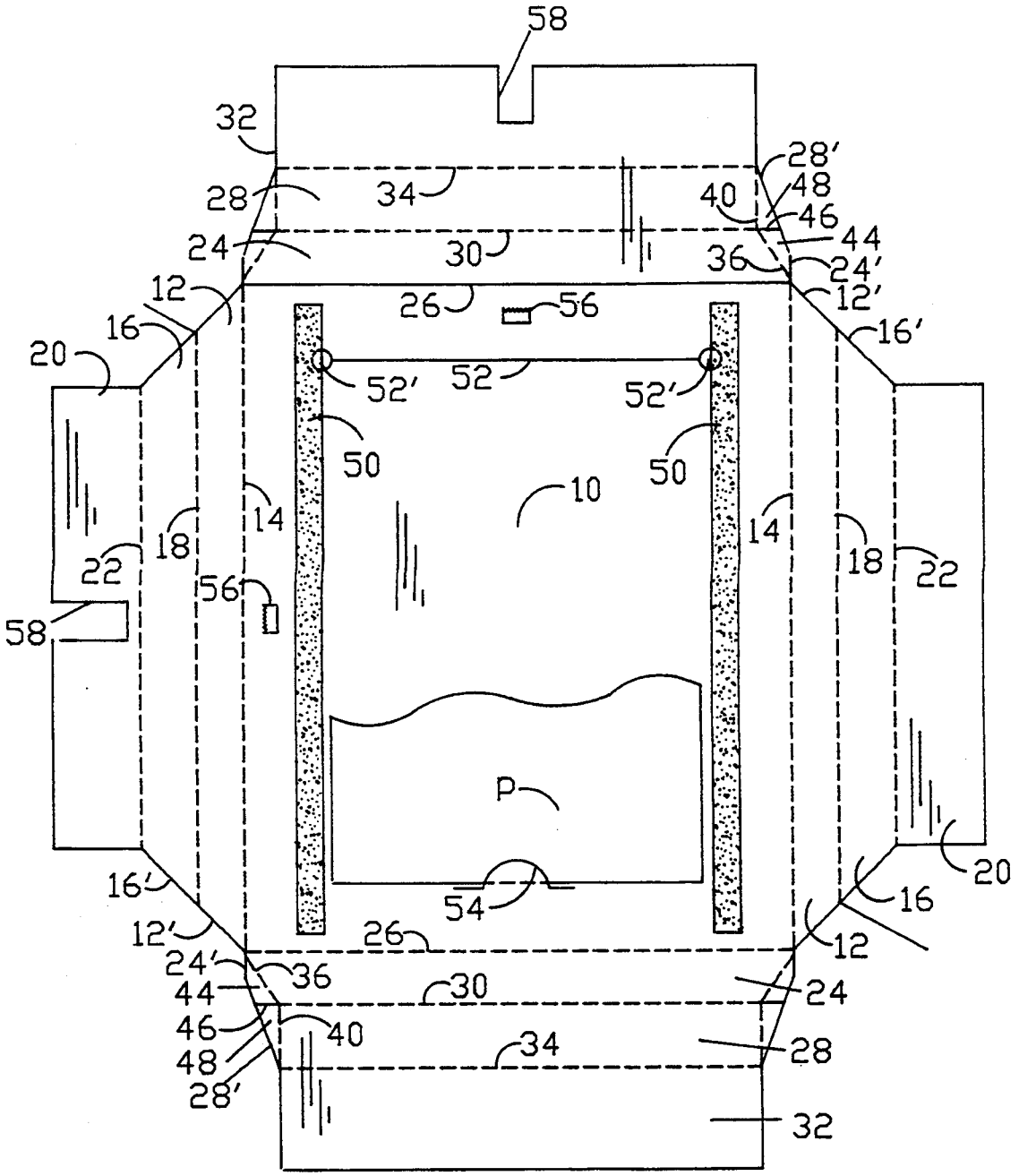
FIG. 5 is a plan view of an alternate embodiment of a sheet blank utilizing a picture-securing thumb tab 54 to secure a photograph P and only two raised adhesive strips 50.

FIG. 1 and 5 illustrate a picture-installing slot 52 through base section 10 by which pictures may be easily inserted and exchanged without requiring any disassembly of the picture frame. The picture installing slot 52 is configured and positioned to permit an appropriately sized picture or photograph to be slid into and out of the picture-receiving channel from the backside of the assembled picture frame. The picture-installing slot 52 may also include circular end punch-outs 52' which are known to permit opening of the slot without tearing of the paper at the ends of the slot. Also illustrated are serrated hangers 56 by which the frame may be hung and adjusted by moving the frame to the left or right along the serrations to balance the frame. The corresponding segments 20, 32 may include notches 58 to accommodate the use of the hangers 56.

As seen in FIG. 2, upon assembly, extension flap members 44, 48 of the second opposed peripheral side sections are configured to extend beyond and under the corner edge 12', 16' of the first peripheral side sections. To keep the second opposed peripheral side sections from interfering with the overlapping first opposed pair of peripheral side sections, scored fold lines 36 and 40 act as hinges that enable the extension flap members 44 and 48 to bend while under pressure. This hinged extension flap configuration provides visual closure and a mitered appearance at the corners.

Beginning with the second opposed peripheral side sections of the frame, the inner segments 24 are folded upwardly at scored fold lines 26. Middle segments 28 are folded upwardly at scored fold lines 30. The outer segments 32 are similarly folded along scored fold lines 34, tucked under into a folded condition in which the outer edge of segment 32 is moved into aligned abutment with scored fold line 26 and secured to the raised adhesive strips 50'. The inner, middle and outer segments I 2, 16 and 20, respectively, of the first opposed peripheral side sections are then folded, tucked under and secured to the raised adhesive strips 50 in the same manner as described above. Extension flap members 44, 48 of the second opposed peripheral side sections are overlapped and depressed by the first opposed peripheral side sections to prevent any unsightly gaping at the corners. A picture of choice is inserted through the picture-installing slot 52 and retained in place by the pocket formed by the raised adhesive strips 50, 50'. The frame is then hung by one of the serrated hangers 56, the serration allowing for the center of gravity of the frame to be shifted to balance the frame.

Figure 6:
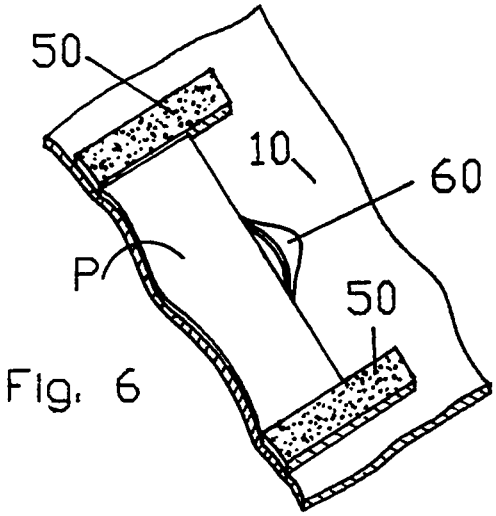
FIG. 6 is a fragmentary, perspective view showing a portion of the base section 10 of a sheet blank having an alternate picture securing arrangement utilizing a die cut and embossed paper stop 60 to secure a picture P and only two raised adhesive strips 50.

FIG. 5 illustrates that the base section 10 may alternatively be provided, if desired, with a die cut thumb tab 54 which acts as a catch to properly position a picture P within the channel and prevent it from slipping, therein. In this embodiment, the tab 54 is provided as an alternative to the enclosing adhesive strips 50' which otherwise define the picture placement within the channel formed by strips 50. Another alternative is shown in FIG. 6 wherein a die cut and embossed paper stop 60 acts as a picture catch, and in conjunction with the raised adhesive strips 50, prevents the picture P from slipping.

From the foregoing it will be apparent to those skilled in the art that various structural features described in connection with one embodiment may be utilized as alternatives for structural features described in connection with other embodiments. These may include the thumb tab or paper stop such as shown in FIGS. 5 and 6. In these versions, only two raised adhesive strips are necessary to form a channel to align and retain the picture in place. Various changes in shapes and ornamentation may also be accomplished by varying the particular cutout of the blank and the various spacing between scored fold lines, as will be appreciated.

It is important to note, however, that the provision of the hinged extension flap members 44 and 48 enable the sides of the frame of this invention, when folded, to produce a frame that achieves visual closure at the corners of the frame. Since the extension flap members provide visual closure automatically when the peripheral side sections are folded under and secured, the assembly process is simplified over previous inventions requiring difficult to assemble locking tabs to eliminate the gap at the corners.

From the foregoing it will be apparent to those skilled in the art that various changes other than those described previously may be made in the size, shape, type, number, arrangement and orientation of parts described hereinbefore without departing from the spirit of this invention and the scope of the appended claims.

Having thus described my invention and the manner in which it may be used, I claim:

1. A picture frame blank made flexible sheet material foldable to form a picture frame, the blank comprising a central rectilinear base section, a first pair of opposed peripheral side sections extending from said central base section, a second pair of opposed peripheral side sections extending from said central base section, scored fold lines defining a boundary between each of said peripheral side sections and said central base section, a plurality of fold lines on each of said peripheral side sections defining individual side segments, wherein said segments are configured to be folded inwardly forming three dimensional frame sides, said frame sides are secured to said central base section by a pair of raised adhesive strips mounted directly on said central base section, said adhesive strips positioned parallel to one another, said adhesive strips forming a centrally disposed, open-ended picture-receiving channel for confined reception of a picture thereinbetween, the channel having a pair of open ends, a picture stop means on the base section bordering at least one of the open ends of said picture-receiving channel, said picture stop means for engaging an edge of a picture confined in the channel to retain the picture in proper position therein.

2. The blank of claim 1 including a photo-installing slat cut through the base section and configured to extend across said picture-receiving channel adjacent one of its open ends, whereby a picture may be inserted into and removed from a picture-receiving channel from the back side of the base section.

3. The blank of claim 1 wherein said picture stop means comprises a raised adhesive strip mounted on the base section bordering at least one of the open ends of said picture-receiving channel and positioned to extend perpendicularly relative to said pair of raised adhesive strips to close one of the ends of the channel and provide an abutment for the confronting edge of a picture contained within the picture-receiving channel.

4. The blank of claim 1 wherein said picture stop means comprises a die cut and embossed paper stop formed in the base section bordering at least one of the open ends of said picture-receiving channel, said paper stop configured to provide a picture-engaging abutment for a confronting edge of a picture contained within the picture-receiving channel.

5. The blank of claim 1 wherein said picture stop means comprises a die cut picture-engaging tab member formed in the base section bordering at least one of the open ends of said picture-receiving channel, said tab member configured to provide a picture-engaging abutment for the confronting edge of a picture contained within the picture-receiving channel.

6. The blank of claim 1 wherein said plurality of fold lines on each of said peripheral side sections define inner, middle, and outer segments extending respectively from said central base section, said segments configured to be folded inwardly forming three dimensional side elements, said inner and middle segments of said second pair of opposed peripheral side sections including outwardly projecting extension flap members, scored fold lines acting as a hinge between each of the said segments and their respective extension flap members, said hinged extension flap members being overlapped by said first pair of opposed peripheral side sections when all the peripheral frame sections are folded into three dimensional side elements, said hinged extension flap members prevent unsightly corner gaps between adjacent said three dimensional elements.

7. A picture frame blank made of flexible sheet material foldable to form a picture frame, the blank comprising a central rectilinear base section, a first pair of opposed peripheral side sections extending from said central base section, a second pair of opposed peripheral side sections extending from said central base section, scored fold lines defining a boundary between each of said peripheral side sections and said central base section, a plurality of fold lines on each of said peripheral side sections defining inner, middle, and outer segments extending respectively from said central base section, said segments configured to be folded inwardly forming three dimensional side elements, said inner and middle segments of said second pair of opposed peripheral side sections including outwardly projecting extension flap members, scored fold lines acting as a hinge between each of the said segments and their respective extension flap members, said extension flap members being overlapped by said first pair of opposed peripheral side sections when all the peripheral frame side sections are folded into three dimensional side elements, said extension flap members prevent unsightly corner gaps between adjacent said three dimensional elements, and adhesive means for securing said three dimensional elements to said base section, and picture stop means on the base section for engaging and confining the picture in proper position therein.

8. The blank of claim 7 including a photo-installing slot cut through the base section parallel to one of said peripheral side sections, whereby a picture may be inserted into and removed from the assembled frame.

9. The blank of claim 7 wherein said picture stop means comprises a raised adhesive strip mounted on the base section parallel to one of said peripheral side sections, said strip configured to provide a picture-engaging abutment for a confronting edge of a picture.

10. The blank of claim 7 wherein said picture stop means comprises a die cut and embossed paper stop formed in the base section parallel to one of said peripheral side sections, said stop means configured to provide a picture-engaging abutment for a confronting edge of a picture.

11. The blank of claim 7 wherein said picture stop means comprises a die cut picture-engaging tab member formed in the base section parallel to one of said peripheral side sections, said tab member configured to provide a picture-engaging abutment for a confronting edge of a picture.

12. The blank of claim 7 wherein a pair of raised adhesive strips mounted on said central base section, said adhesive strips positioned parallel to one another, said strips forming a centrally disposed, open-ended picture-receiving channel for confined reception of a picture thereinbetween.

* * * * *